United States Patent [19]

Stalder et al.

[11] Patent Number: 4,848,079

[45] Date of Patent: Jul. 18, 1989

[54] FRICTION SPINNING DRUM

[75] Inventors: Herbert Stalder, Kollbrunn; Urs Keller, Seuzach; Werner Oeggerli; Emil Briner, both of Winterthur, all of Switzerland

[73] Assignee: Maschinenfabrik Rieter AG, Winterthur, Switzerland

[21] Appl. No.: 119,496

[22] Filed: Nov. 12, 1987

[30] Foreign Application Priority Data

Nov. 13, 1986 [CH] Switzerland ..... 04542/86

[51] Int. Cl.[4] ..... D01H 7/882; D01H 7/885

[52] U.S. Cl. ..... 57/401; 57/415

[58] Field of Search ..... 57/400, 401, 404, 414, 57/416, 334, 335

[56] References Cited

U.S. PATENT DOCUMENTS

| | | | |
|---|---|---|---|
| 4,281,507 | 8/1981 | Didek et al. | 57/401 |
| 4,315,398 | 2/1982 | Parker et al. | 57/401 |
| 4,358,922 | 11/1982 | Feldstein | 57/401 |
| 4,358,923 | 11/1982 | Feldstein | 57/401 |
| 4,372,109 | 2/1983 | Farnhill et al. | 57/401 |
| 4,404,792 | 9/1983 | Parker et al. | 57/401 |
| 4,522,022 | 6/1985 | Parker et al. | 57/401 |
| 4,601,166 | 7/1986 | Raasch | 57/401 |
| 4,760,693 | 8/1988 | Billner | 57/401 |

FOREIGN PATENT DOCUMENTS

| | | |
|---|---|---|
| 2943063 | 5/1980 | Fed. Rep. of Germany . |
| 61-47080 | 3/1986 | Japan . |
| 2074201 | 10/1981 | United Kingdom . |

*Primary Examiner*—John Petrakes

*Attorney, Agent, or Firm*—Werner W. Kleeman

[57] ABSTRACT

In the manufacture of friction spinning drums, in order to be able to select the size of the holes or perforations, on the one hand, to oppose technological fiber loss and jamming of sucked in foreign particles and, on the other hand, to provide airflow advantages, it is proposed to manufacture the friction spinning drum from a thick-walled support and a thin-walled perforated body. As a result, holes or perforations having a sufficiently small cross-section to counteract the above-mentioned fiber loss can be formed in the thin-walled perforated body. On the other hand, holes or perforations having a large enough cross-section to prevent jamming of sucked in foreign particles or other contaminants can be provided in the thick-walled support.

14 Claims, 2 Drawing Sheets

FRICTION SPINNING DRUM

CROSS REFERENCE TO RELATED APPLICATIONS

This application is related to the commonly assigned, copending U.S. application Ser. No. 07/117,841, filed Nov. 9, 1987, and entitled "METHOD FOR MANUFACTURING A PERFORATED BODY, FRICTION SPINNING MEANS USING THE PERFORATED BODY AND A FRICTION SPINNING DEVICE USING THE FRICTION SPINNING MEANS", and the commonly assigned, co-pending U.S. application Ser. No. 07/119,497, filed Nov. 12, 1987, and entitled "OPEN END FRICTION SPINNING DEVICE FOR PRODUCTION OF A YARN OR THE LIKE AND METHOD FOR PRODUCTION OF FRICTION SPINNING MEANS" the disclosures of which are incorporated herein by reference.

BACKGROUND OF THE INVENTION

The present invention relates to a new and improved construction of a friction spinning drum of the type comprising a hollow perforated drum designed for substantially radial throughflow of air.

Such friction spinning drums are used in known friction spinning processes or methods in which usually two cylindrical drums arranged adjacent each other rotate in the same direction, at least one of the two drums being a perforated drum as above described.

The purpose of such perforated drum is to take up fibers fed thereto in known manner by means of an airstream and to twist them into a yarn in the region of convergence of the two friction spinning drums. The yarn is withdrawn in a direction substantially at right angles to the direction of rotation of the friction spinning drums.

The airstream required to feed the fibers is drawn through the holes or perforations of the perforated drum by means of a suction nozzle provided in the interior of such perforated drum.

It therefore should be manifest that, on the one hand, the holes or perforations of the perforated drum must have a diameter which substantially prevents too many fibers being taken up or engaged by the holes or perforations during deposition on the perforated drum and then being either sucked away and hence lost, or at least being cut on the edge of the mouth of the suction nozzle and thereby undesirably shortened.

On the other hand, the energy consumption of such equipment must be held as low as possible, the airflow representing a significant proportion of the energy consumption. From this standpoint, it is desirable to design the holes or perforations of the perforated drum with the largest possible diameter to present the lowest possible resistance to the required throughflow quantity of air per unit time.

These two requirements placed on the diameter of the holes or perforations are diametrically opposed to each other.

In normal practice, and from patent publications, it is known that these holes or perforations generally have a diameter between 0.5 and 0.8 mm.

On the other hand, the perforated drums must have inherent stiffness or rigidity in order to avoid deformation during use, thereby requiring a minimum wall thickness of at least 1.5 mm in such perforated drums when made of brass with, for example, a drum diameter of 50 mm.

It is, however, clear that boring or otherwise fabricating such small holes in a material of 1.5 mm thickness or greater cannot be carried out without problems. Thus such operation is therefore expensive, particularly when the number of holes or perforations per perforated drum is of the order of several tens of thousands.

When additional demands are placed on the configuration or form of the holes or perforations, as disclosed in the German Published Pat. No. 2,919,316, the manufacturer of such perforated drums is confronted with special problems.

SUMMARY OF THE INVENTION

Therefore, with the foregoing in mind, it is a primary object of the present invention to provide a new and improved construction of a friction spinning drum which is not afflicted with the aforementioned drawbacks and shortcomings of the prior art.

Another important object of the present invention is to provide a new and improved construction of a perforated drum which can be manufactured economically with adequate inherent stiffness or rigidity and low airflow resistance.

Yet a further significant object of the present invention resides in economically fabricating a friction spinning drum composed of two parts wherein the holes or perforations of the friction spinning drum are particularly structured to comply as well as possible with the conflicting demands of reduced airflow resistance through the holes or perforations and avoidance to the extent possible of undesired sucking in or engagement of the fibers deposited upon the outer surface or fiber receiving surface of the friction spinning drum.

Now in order to implement these and still further objects of the invention, which will become more readily apparent as the description proceeds, the friction spinning drum of the present development is manifested by the features that it comprises an inner perforated support body or support and an outer perforated body secured thereto.

Advantageously, the holes or perforations of the inner perforated support body exhibit a larger cross-sectional area or cross-section than that of the holes or perforations of the outer perforated body. Furthermore, it is advantageous for the manufacturing operation if the inner perforated support body comprises a rigid hollow body or body member and the outer perforated body is a flexible body or body member mounted on the inner perforated support body. This outer perforated body or body member can comprise a metal band mounted on the inner perforated support body in a spiral or helical configuration, or a rectangular foil mounted on the inner perforated support body. Equally, the outer perforated body can be mounted on the inner perforated support body in the form of a tubular foil.

The holes or perforations in the inner perforated support body and the holes or perforations in the outer perforated body can be coaxially arranged.

Certain of the more notable advantages of the present invention reside in the features that, on the one hand, the small diameter holes or perforations, which are difficult to fabricate, can be formed in a relatively thin or thin-walled material while the relatively thick or thick-walled support body or body member can be provided with holes or perforations which have a cross-section or cross-sectional area which is selected more appropriately in accordance with the greater wall thickness.

A further advantage of the present invention resides in the fact that the outer perforated body or body member can be constituted by a band or foil capable of being mounted or drawn on (even when a foil in a second operation is joined to make up a tubular perforated body). The side of the perforated foil having burrs or the like can then be arranged as the external face or surface of the outer perforated body. If a galvanic coating is then subsequently applied, this affords the further advantage that the holes or perforations widen or enlarge from the outside towards the inside. This hole widening or enlargement is advantageous not simply in relation to the pneumatic resistance of the individual hole or perforation; dirt particles which possibly penetrate into one of the holes or perforations cannot jam in the adjoining hole or perforation section or region.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
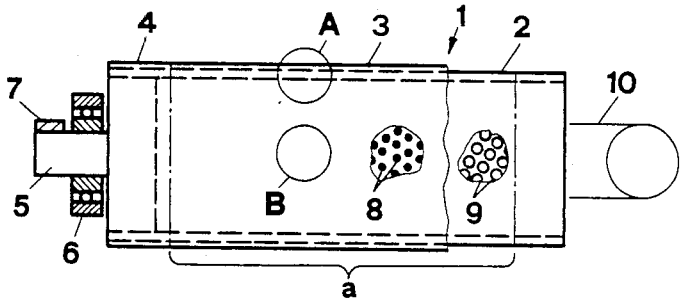
FIG. 1 illustrates a front view of a friction spinning drum constructed in accordance with the present invention.

Describing now the drawings, it is to be understood that to simplify the showing thereof, only enough of the structure of the friction spinning drum has been illustrated therein as is needed to enable one skilled in the art to readily understand the underlying principles and concepts of the present invention. Turning now specifically to FIG. 1 of the drawings, the friction spinning drum 1 illustrated therein by way of example and not limitation, will be seen to comprise an inner support body or body member 2 with an outer perforated or sieve body or body member 3 mounted thereon. The form or structure of this outer perforated body or body member 3 will be described hereinafter.

The inner support body or body member 2 is designed as a hollow body and is firmly connected at one end with a stub-shaft 4 or equivalent structure. A shaft 5 operatively associated with the stub-shaft 4 serves to receive a roller bearing 6 or the like by means of which the friction spinning drum 1 is rotatably supported. As a means for driving the friction spinning drum 1 there can be provided, for instance, a drive belt 7 which engages the shaft 5.

As shown in sectional view in FIG. 1, the outer perforated body 3 has holes or perforations 8 and the inner support body 2 has throughbores or throughholes 9. A suction nozzle 10 or equivalent structure provided at the opposite axial end of the friction spinning drum 1 projects in known manner into the inner support body 2 and draws or sucks in air through the holes or perforations 8 and throughbores or throughholes 9 by means of a suitable nozzle mouth (not shown) of the suction nozzle 10 and which suction nozzle mouth is arranged close to the cylindrical internal wall of the inner support body or body member 2. This suction nozzle or suction arrangement 10 is well known from friction spinning technology and is therefore not here described in further detail, particularly since such is unimportant in terms of the teachings and the principles of the present invention.

The holes or perforations 8 and the throughbores or throughholes 9 are respectively provided in the inner support body 2 and the outer perforated body 3 within a perforated region as indicated in dot-dash lines. The holes or perforations 8 and the throughbores or throughholes 9 collectively form the holes or perforations 8,9 of the perforated friction spinning drum 1.

Figure 2:
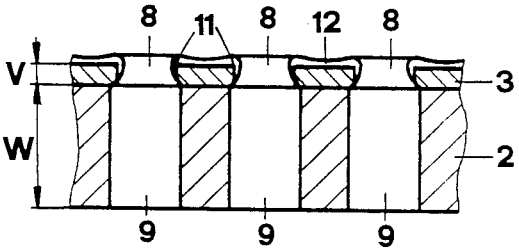
FIG. 2 illustrates an enlarged detail of the region of the friction spinning drum within the circle A depicted in FIG. 1 and illustrated in sectional view.

FIG. 2 shows a detail of the inner support body 2 and the outer perforated body 3 indicated at the region of the friction spinning drum 1 enclosed within the circle A in FIG. 1. The wall thickness of the inner support body 2 is designated W and the wall thickness of the outer perforated body 3 is designated V.

It is further apparent that the manufacturing burrs 11 (which have been exaggerated for clarity of illustration and comprehension) are directed towards the exterior or outer surface of the friction spinning drum 1. Further, the outer perforated body 3 is coated on its outer cylindrical surface, defining a fiber receiving surface, with a galvanic coating or layer 12, which may be roughened in any suitable manner, and which for physical reasons builds up more strongly around the burrs 11 than in the adjacent surface portions or regions. In addition, with a coating thickness which is predetermined in relation to the wall thickness V of the outer perforated body 3, the galvanic coating 12 also builds up, as shown in FIG. 2, in such manner in the depth of the holes or perforations 8 that such holes or perforations take on a form similar to a diffusor. This affords the advantages discussed in the introductory portion of this disclosure, namely that, on the one hand, the diffusor-like form or configuration provides an airflow advantage and, on the other hand, dirt particles or other contaminants sucked into the holes or perforations 8 cannot jam therein.

A further advantage of the stronger or more pronounced build-up of the galvanic coating 12 or the like around the manufacturing burrs 11 is that a small annular projection is created around each hole or perforation 8. This desirably improves the friction properties of the outer or fiber receiving surface of the outer perforated body 3.

The wall thickness W (FIG. 2) of an inner support body 2 made of, for instance, brass can, for example, lie in the range 1.5 to 2 mm, and the wall thickness V of an outer perforated body 3 made of, for instance, nickel-chrome alloy can be 0.5 to 0.8mm. The thickness of the galvanic coating 12 is about 0.2 mm in the surface regions between the annular projections. There also may be applied a plasma coating or layer upon the galvanic coating or layer 12.

Figure 3:
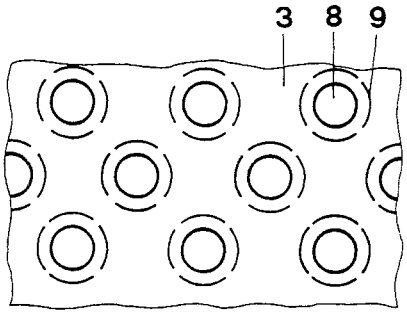
FIG. 3 illustrates an enlarged detail of the region of the friction spinning drum within the circle B depicted in FIG. 1 and taken from the surface of the friction spinning drum of FIG. 1.

Further, it will be seen from FIGS. 2 and 3 that the throughbores or throughholes 9 have a larger cross-section or cross-sectional area than the smallest cross-section or cross-sectional area of a hole or perforation 8. In the case where the holes or perforations 8 are round, the smallest cross-section or cross-sectional area of each hole or perforation 8 can, for example, have a diameter of 0.5 mm and the diameter of the throughbore throughhole 9 can be 0.8 to 1mm, depending upon the hole spacing, so that the inner support body 2 still provides sufficient material between the throughbores or throughholes 9 to enable it to fulfill its purpose as regards strength.

This affords the advantage that, as a result of the small wall thickness V, the holes or perforations 8 of the outer perforated body 3 can be bored or otherwise appropriately machined without problems using conventional boring, punching or electron beam boring technology. As a result of their significantly greater diameter, the throughbores or throughholes 9 of the inner support body 2 can be bored without problems using conventional boring techniques even when the wall thickness is 2 mm or more.

As is also apparent from FIGS. 2 and 3, the holes or perforations 8 are arranged coaxially with respect to the throughbores or throughholes 9, although this is not absolutely necessary. It is possible to use significantly larger throughbores or throughholes 9 which do not have the same gauge as the holes or perforations 8; the term "gauge" refers in this disclosure to the spacing of the hole centers.

Furthermore, the sum of all cross-sectional areas of the holes or perforations 9 in the inner support body 2 represents a greater proportion of the total surface of the perforated region a than the sum of all cross-sectional areas of the holes or perforations 8 of the outer perforated body 3.

Figure 4:
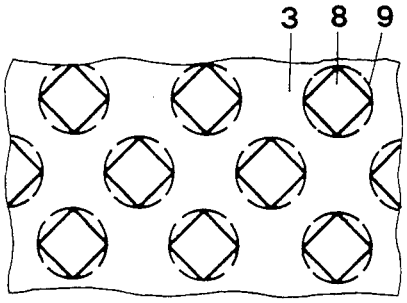
FIG. 4 illustrates a modification of the surface of the friction spinning drum shown in FIG. 3.

In addition, it can be seen from FIG. 4 that the holes or perforations 8 in the outer perforated body 3 do not necessarily have to have a round section. Other hole forms or configurations are possible, especially when a punching technique is used during manufacture. In FIG. 4, four-sided holes or perforations 8 have been shown, but holes or perforations with other forms could also be used. The same applies to the throughbores or throughholes 9 in the event that another fabrication technique is used in place of boring to produce the throughbores or throughholes 9 in the inner support body 2, for example injection molding.

Figure 5:
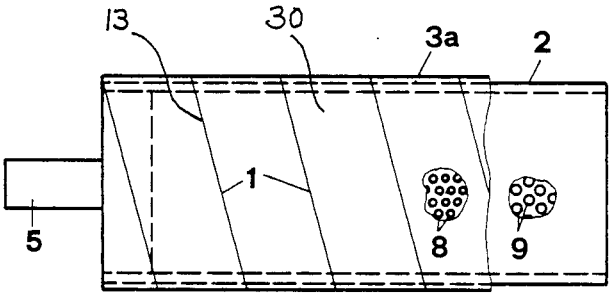
FIGS. 5, 6 and 7 illustrate respective views of possibilities of use of a friction spinning drum according to FIG. 1.
Figure 6:
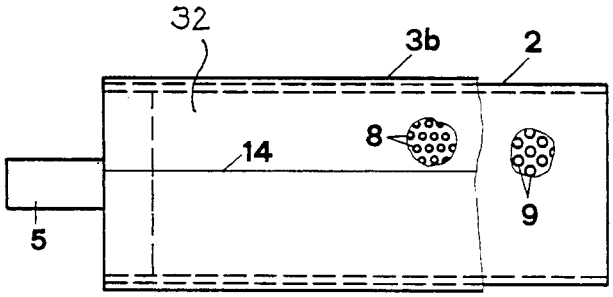
Figure 7:
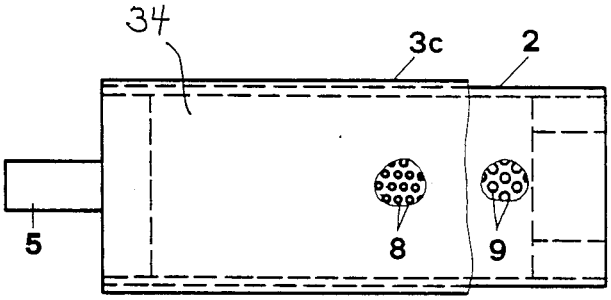

FIGS. 5, 6 and 7 show various ways in which the outer perforated body 3 can be formed and mounted on the inner support body 2.

FIG. 5 illustrates an outer perforated body, here designated by reference character 3*a*, in a band-form, for instance formed of any suitable metal, and which is spirally or helically wound on the inner support body 2 and connected thereto by any suitable connecting means. The connection can be effected, for example, by a suitable adherance or adhesion technique in that the start and finish of the band-form or band-shaped outer perforated body 3*a* is adhesively bonded to the inner support body 3 in the zones located outside the perforated region a. The spiral winding is carried out in such manner that the turns or coils 30 of the band-shaped outer perforated body 3*a* contact or abut each other in order to prevent throughflow of air at the region of the joins or joints 13. Furthermore, there exists the possibility of welding the band turns or coils 30 together at the region of the joins or joints 13 by a laser beam.

In FIG. 6, the outer perforated body, here designated by reference character 3*b*, consists of a rectangular foil 32 mounted on the inner support body 2 and engaging sealingly thereon without forming any spaces at the joins or joints 14. Furthermore, the joins or joints 14 can also be welded by means of a laser beam.

In FIG. 7, the outer perforated body, here designated by reference character 3*c*, comprises a hollow body 34, such as a tubular foil, made of a material having a lower coefficient of expansion than the inner support body 2, i.e. since the selection of the material for the outer perforated body 3*c* takes precedence, the material of the inner support body 2 is selected to exhibit a greater coefficient of expansion than the outer perforated body 3*c*. For mounting of the outer perforated body 3*c*, such outer perforated body 3*c* and the inner support body 2 are cooled to a temperature substantially below normal ambient so that the inner support body 2 shrinks during cooling to a greater extent than the outer perforated body 3*c*. This enables problem-free mounting of the outer perforated body 3*c* on the inner support body 2. The external diameter of the inner support body 2 is so selected in comparison to the internal diameter of the outer perforated body 3*c* that upon warming to normal temperature (not as high as operating temperature) the outer perforated

3*c* seats firmly and without rotation on the inner support body 2. During warming to operating temperature, a predetermined pretension is generated in the outer perforated body 3*c*.

The manufacture of a hollow body of this type can be performed galvanically and is disclosed in the previously mentioned commonly assigned, copending U.S. application Ser. No. 07/117,841, filed Nov. 9, 1987, and entitled "METHOD FOR MANUFACTURING A PERFORATED BODY, FRICTION SPINNING MEANS USING THE PERFORATED BODY AND A FRICTION SPINNING DEVICE USING THE FRICTION SPINNING MEANS"

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A friction spinning drum comprising:

a hollow perforated drum structured for substantially radial throughflow of air;

said hollow perforated drum comprises an inner perforated support body and an outer perforated body; and said outer perforated body constitutes a separate sieve body which is mounted upon and rotatable with said inner perforated support body.

2. The friction spinning drum as defined in claim 1, wherein:

said inner perforated support body has holes;

said outer perforated body has holes; and the holes of the inner perforated support body have a large cross-sectional area than the holes of the outer perforated body.

3. The friction spinning drum as defined in claim 2, wherein:

the holes of the inner perforated support body and the holes of the outer perforated body are disposed substantially coaxially with respect to one another and collectively define perforations of the hollow perforated drum.

4. The friction spinning drum as defined in claim 2, wherein:

the sum of the cross-sectional areas of the holes of the inner perforated support body constitutes a greater proportion of a predeterminate total surface of a perforated region of the inner perforated support body than the sum of the cross-sectional areas of the holes of the outer perforated body.

5. The friction spinning drum as defined in claim 2, wherein:

the holes of the outer perforated body contain burrs surrounding said holes; and the outer perforated body is mounted on the inner perforated support body such that said burrs surrounding the holes of the outer perforated body are located on an external surface of said outer perforated body.

6. The friction spinning drum as defined in claim 1, wherein:

the inner perforated support body comprises a rigid hollow body; and the outer perforated body comprises a spiral metal band mounted on the inner perforated support body.

7. The friction spinning drum as defined in claim 1, wherein:

the outer perforated body comprises a spiral metal band mounted on the inner perforated support body.

8. The friction spinning drum as defined in claim 1, wherein:

the outer perforated body comprises a substantially rectangular foil mounted on the inner perforated support body.

9. The friction spinning drum as defined in claim 1, wherein:

the outer perforated body comprises a substantially tubular foil mounted on the inner perforated support body.

10. The friction spinning drum as defined in claim 1, wherein:

the outer perforated body has an outer surface; and a coating provided on the outer surface of the outer perforated body.

11. The friction spinning drum as defined in claim 10, wherein:

said coating provided on the outer surface of the outer perforated body comprises a galvanic coating.

12. The friction spinning drum as defined in claim 11, wherein:

the galvanic coating constitutes a roughened galvanic coating.

13. The friction spinning drum as defined in claim 10, wherein:

the coating provided on the outer surface of the outer perforated body comprises a galvanic coating and a plasma coating applied onto said galvanic coating.

14. A friction spinning drum comprising:

a hollow perforated drum structured for substantially radial throughflow of air;

said hollow perforated drum comprises an inner perforated support body and an outer perforated body;

said outer perforated body constitutes a separate, sieve body which is mounted upon and rotatable with said inner perforated support body;

said inner perforated support body has holes;

said separate sieve body has holes; and the holes of the inner perforated support body have a larger cross-sectional area with respect to minimizing air flow resistance than the smaller cross-sectional area of the holes of the separate sieve body dimensioned with respect to minimizing fiber loss and damage.

* * * * *

UNITED STATES PATENT AND TRADEMARK OFFICE

CERTIFICATE OF CORRECTION

PATENT NO. : 4,848,079

DATED : July 18, 1989

INVENTOR(S) : HERBERT STALDER et al

It is certified that error appears in the above-identified patent and that said Letters Patent is hereby corrected as shown below:

Column 6, line 28, after "perforated" please insert --body--

Column 7, line 25, after "a" please insert --flexible body-- and delete "spiral metal"

Column 7, line 26, please delete "band"

Signed and Sealed this

Eighth Day of May, 1990

*Attest:*

HARRY F. MANBECK, JR.

*Attesting Officer*

*Commissioner of Patents and Trademarks*